US007306159B1

(12) United States Patent
Rochelo

(10) Patent No.: US 7,306,159 B1
(45) Date of Patent: Dec. 11, 2007

(54) PROTECTIVE CASE FOR SIX DIFFERENT SIZED MEMORY CARDS

(76) Inventor: Donald R. Rochelo, 66 Leona Dr., Pittsfield, MA (US) 01201

( * ) Notice: Subject to any disclaimer, the term of this patent is extended or adjusted under 35 U.S.C. 154(b) by 499 days.

(21) Appl. No.: 10/860,471

(22) Filed: Jun. 3, 2004

Related U.S. Application Data

(60) Provisional application No. 60/476,518, filed on Jun. 7, 2003.

(51) Int. Cl.
*G06K 19/06* (2006.01)
*G06K 7/00* (2006.01)
*H05K 1/14* (2006.01)
*B65D 73/00* (2006.01)
*B65D 85/30* (2006.01)

(52) U.S. Cl. ..... 235/492; 235/486; 361/737; 206/472; 206/473; 206/483; 206/308.3

(58) Field of Classification Search ..... 206/472, 206/473, 474, 477, 480, 482, 483, 485–486, 206/320, 305, 308.3; 361/737, 727, 686; 40/642.02; 220/4.22, 526; 190/109; 235/486, 235/492; 439/61, 135, 945–946; 224/277, 224/929
See application file for complete search history.

(56) References Cited

U.S. PATENT DOCUMENTS 1,613,414 A * 1/1927 Schickerling ..... 206/39.7
2,261,806 A * 11/1941 Hills ..... 312/9.43
3,483,909 A * 12/1969 Mascolo et al. ..... 150/139
3,648,832 A * 3/1972 Kirshenbaum et al. ..... 206/37
3,734,155 A * 5/1973 Stenger ..... 150/148
4,164,309 A * 8/1979 Staats ..... 206/425
4,198,105 A * 4/1980 Gibbs ..... 312/183
4,209,093 A * 6/1980 Soderland ..... 206/425
4,324,330 A * 4/1982 Durney ..... 206/708
4,470,488 A * 9/1984 Broussard ..... 190/16
4,674,628 A * 6/1987 Prinsloo et al. ..... 206/38.1
4,716,948 A * 1/1988 Brissette ..... 150/132
4,871,066 A * 10/1989 LaWall ..... 206/425
4,907,634 A * 3/1990 Yoo ..... 150/135
4,946,030 A * 8/1990 Guridi et al. ..... 206/37.1
5,097,953 A * 3/1992 Gingras ..... 206/454
5,343,144 A * 8/1994 Kobayashi ..... 324/158.1
5,370,419 A * 12/1994 Takayama ..... 281/31
5,445,199 A * 8/1995 Jia ..... 150/136
5,474,178 A * 12/1995 DiViesti et al. ..... 206/723
5,506,395 A * 4/1996 Eppley ..... 235/486
5,553,712 A * 9/1996 Tisbo et al. ..... 206/752
5,651,202 A * 7/1997 Hewitt ..... 40/605

(Continued)

*Primary Examiner*—Daniel Walsh
(74) *Attorney, Agent, or Firm*—Malcolm J. Chisholm, Jr.

(57) ABSTRACT

A protective case (10) for six different sized memory cards (20, 34, 50, 62, 75, 90) having distinct exterior dimensions of length, width and/or thickness includes a base (12) and a top (14) hinged to the base (12) for opening and closing. The base (12) includes securing means (18, 32, 48, 60) for securing a first small sized memory card (20) and first, second and third large sized memory cards (34, 50, 62). The top (14) includes a second small sized memory card securing means (74) for securing second and third small sized memory cards (75, 90). The securing means define rectangular alignments (26, 42, 56, 70, 80) approximating exterior length and width dimensions of the six cards (20, 34, 50, 62, 75, 90) and the rectangular alignments (26, 42, 56, 70, 80) overlie each other resulting in a very small case (10).

14 Claims, 6 Drawing Sheets

U.S. PATENT DOCUMENTS 5,676,223 A * 10/1997 Cunningham ..... 190/109
5,706,935 A * 1/1998 Lorton ..... 206/38
5,706,954 A * 1/1998 Detjen ..... 209/702
5,775,398 A * 7/1998 Siegel ..... 150/139
5,790,027 A * 8/1998 Chern ..... 340/568.7
5,860,518 A * 1/1999 Axelrod ..... 206/224
5,894,597 A * 4/1999 Schwartz et al. ..... 455/558
5,915,548 A * 6/1999 Sasaki ..... 206/307.1
5,992,618 A * 11/1999 Joh ..... 206/39
6,097,605 A * 8/2000 Klatt et al. ..... 361/737
6,155,410 A * 12/2000 Davis ..... 206/39.5
6,184,788 B1 * 2/2001 Middlemiss et al. ..... 340/568.7
6,230,885 B1 * 5/2001 Rochelo et al. ..... 206/308.3
6,304,437 B1 * 10/2001 Foo et al. ..... 361/683
6,349,029 B1 * 2/2002 Leman et al. ..... 361/683
6,412,627 B1 * 7/2002 Tiscione et al. ..... 206/39.4
6,443,306 B1 * 9/2002 Davies et al. ..... 206/473
6,633,491 B2 * 10/2003 Malone et al. ..... 361/825
6,652,178 B2 * 11/2003 Walton ..... 402/79
6,668,883 B2 * 12/2003 Buechele ..... 150/131
6,705,529 B1 * 3/2004 Kettunen et al. ..... 235/486
6,717,817 B2 * 4/2004 Liu et al. ..... 361/737
6,738,259 B2 * 5/2004 Le et al. ..... 361/737
6,739,452 B2 * 5/2004 Rochelo ..... 206/454
6,761,320 B1 * 7/2004 Chen ..... 235/492
6,766,952 B2 * 7/2004 Luu ..... 235/451
6,776,653 B1 * 8/2004 Hsiao ..... 439/541.5
6,820,761 B1 * 11/2004 Mouri et al. ..... 220/6
6,830,150 B1 * 12/2004 Cyr ..... 206/459.1
6,862,175 B1 * 3/2005 McClendon et al. ..... 361/685
6,871,682 B2 * 3/2005 Hogganvik ..... 150/149
6,886,685 B2 * 5/2005 Slater ..... 206/215
6,907,686 B2 * 6/2005 Symons ..... 40/700
6,945,461 B1 * 9/2005 Hien et al. ..... 235/451
6,981,591 B2 * 1/2006 Logan ..... 206/451
7,055,690 B1 * 6/2006 Valdez et al. ..... 206/449
7,066,386 B2 * 6/2006 Izumi ..... 235/381
7,070,453 B1 * 7/2006 Chen ..... 439/630
7,102,516 B2 * 9/2006 Orman ..... 340/570
7,114,993 B2 * 10/2006 Chen ..... 439/630
7,222,205 B2 * 5/2007 Jones et al. ..... 710/301
2002/0074246 A1 * 6/2002 Tiscione et al. ..... 206/39.4
2002/0088736 A1 * 7/2002 Liu ..... 206/526
2003/0024839 A1 * 2/2003 Fulda ..... 206/455
2003/0035279 A1 * 2/2003 Malon et al. ..... 361/796
2003/0057112 A1 * 3/2003 Keough ..... 206/39.4
2003/0062275 A1 * 4/2003 Rochelo ..... 206/308.3
2003/0084220 A1 * 5/2003 Jones et al. ..... 710/301
2003/0085138 A1 * 5/2003 DeVolpi ..... 206/216
2003/0230514 A1 * 12/2003 Baker ..... 206/732
2004/0089717 A1 * 5/2004 Harari et al. ..... 235/441
2004/0124104 A1 * 7/2004 DeVolpi ..... 206/320
2004/0169446 A1 * 9/2004 Tegnelia, Jr. ..... 312/9.48
2005/0023157 A1 * 2/2005 Logan ..... 206/37
2005/0109647 A1 * 5/2005 Frankeny ..... 206/308.1
2005/0150961 A1 * 7/2005 Porter ..... 235/486
2005/0224149 A1 * 10/2005 Tiscione ..... 150/148
2005/0258243 A1 * 11/2005 Hsieh ..... 235/441
2005/0279435 A1 * 12/2005 Coates ..... 150/147
2005/0279655 A1 * 12/2005 Chen ..... 206/307.1
2006/0071073 A1 * 4/2006 Wang ..... 235/441
2006/0105634 A1 * 5/2006 Wu et al. ..... 439/630
2006/0124748 A1 * 6/2006 Obsorn et al. ..... 235/486
2006/0125356 A1 * 6/2006 Meek et al. ..... 312/215
2006/0138726 A1 * 6/2006 Camp et al. ..... 273/273
2006/0144751 A1 * 7/2006 Tsang ..... 206/707
2006/0170313 A1 * 8/2006 Long et al. ..... 312/223.2
2006/0208062 A1 * 9/2006 Obsorn et al. ..... 235/380
2006/0214002 A1 * 9/2006 Hug et al. ..... 235/486
2006/0253636 A1 * 11/2006 Jones et al. ..... 710/301
2007/0147015 A1 * 6/2007 Andretta ..... 361/801

* cited by examiner

PROTECTIVE CASE FOR SIX DIFFERENT SIZED MEMORY CARDS

CROSS REFERENCE TO RELATED APPLICATION

This application claims the benefit of U.S. Provisional Patent Application Ser. No. 60/476,518 that was filed on Jun. 7, 2003, entitled "Protective Case for Six Different Sized Memory Cards".

TECHNICAL FIELD

The present invention relates to protective cases for portable memory cards.

BACKGROUND ART

It is well known that memory devices for storage of data for modern electronic components, such as computers, cameras, entertainment systems, etc., are becoming increasingly smaller. For example, solid memory technology currently and commonly referred to in the art as "memory cards", such as the well known "SONY" brand name "memory sticks" may be readily secured in containers as small as three inches in length and width and one-half inches in depth. Such small memory devices provide substantial conveniences in storing, backing-up and transferring data such as computer programs, visual images, audio data, etc. Because such memory devices are so small, however, they also give rise to significant risks related to transport of the devices. For example, dropping of the devices could damage them, exposure to moisture could likewise injure them, or contact of data transfer ports of the devices with foreign objects could also harm them.

It is known that some modern protective carriers exist for solid memory devices, such as a memory card protective carrier disclosed in U.S. Pat. No. 6,230,885 that issued on May 15, 2001 to the owners of all rights in the invention described herein, which patent is hereby incorporated herein by reference. The memory card protective carrier disclosed therein provides for a protective band to overlie data transfer ports of the memory card whenever the card is secured within the carrier. Similarly, U.S. Pat. No. 6,739,452 that issued on May 25, 2004, and that is also co-owned and incorporated herein by reference, shows a rigid exterior shell housing soft resilient inserts within the shell to completely enclose a memory device and thereby protect it against damage from impact or fluid contamination. However, it is increasingly common that portable memory cards have varying external dimensions of width, length and thickness. Consequently, a user may utilize a protective container for one sized memory card, such as the "SONY" brand name "memory stick", and the container is unlikely to be able to house and protect a memory card having exterior dimensions that vary from those of the "memory stick".

Accordingly, there is a need for a protective case that adequately protects memory cards having varying exterior dimensions.

SUMMARY OF THE INVENTION

The invention is a protective case for six different sized memory cards, wherein each of the six cards has exterior dimensions of length, width and thickness that are distinct from the other five memory cards. The case includes a base hinged to a top, wherein the base includes a first small sized memory card securing means for securing a first small sized memory card within the base against unassisted removal from the case, a first large sized memory card securing means for securing a first large sized memory card within the base against unassisted removal from the case, a second large sized memory card securing means for securing a second large sized memory card within the base against unassisted removal from the case, and a third large sized memory card securing means for securing a third large sized memory card within the base against unassisted removal from the case. The top hinged to the base includes a second small sized memory card securing means for securing both a second small sized memory card and also a third small sized memory card within the top against unassisted removal from the case. A latch is secured to the case for securing the base to the top for selectively opening and closing the case by securing the top to the base to protect one or more memory cards secured within the case. The five securing means are disposed so that whenever the base and top of the case are latched into a closed position, rectangular alignments defined by the five securing means overlie each other.

The securing means include pyramid posts, inverse "L" shaped posts, crush ribs, support shelves, edge posts, alignment ribs and other structures secured to the base or top as described in detail below to secure the memory cards within the case. In a preferred embodiment, the case may simultaneously secure against unassisted removal the first small sized memory card within the base, the second or third small sized memory card within the top, and the first, second or third large sized memory card within the base.

Accordingly, it is a general purpose of the present invention to provide a protective case for six different sized memory cards that overcomes deficiencies of the prior art.

It is a more specific purpose to provide a protective case for six different sized memory cards that is small, easy to store, and that may secure up to three memory cards at the same time.

These and other purposes and advantages of the present protective case for six different sized memory cards will become more readily apparent when the following description is read in conjunction with the accompanying drawings.

DESCRIPTION OF THE PREFERRED EMBODIMENTS

Figure 1:
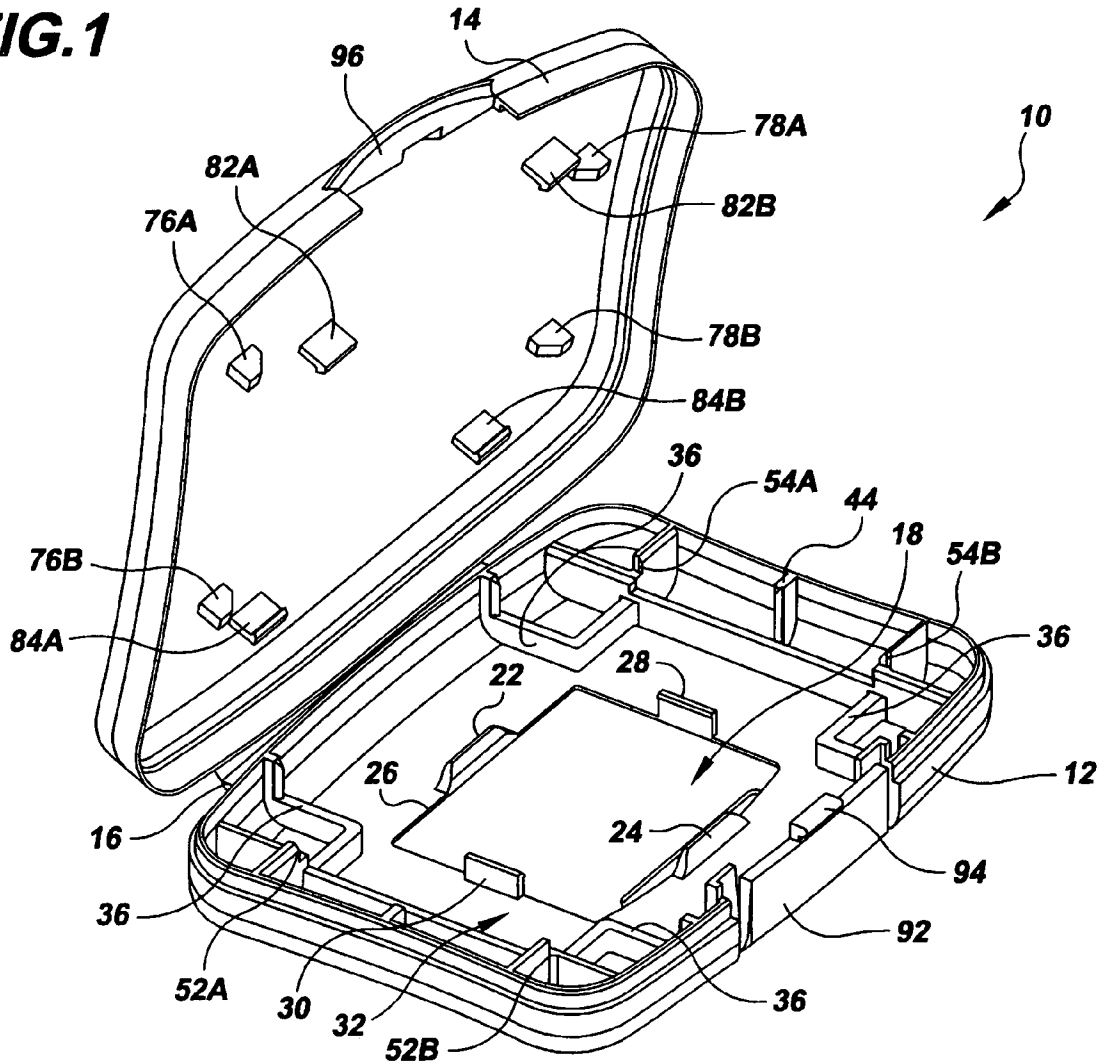
FIG. 1 is a perspective view of a protective case for six different sized memory cards constructed in accordance with the present invention showing a base hinged to a top in an open position.

Referring to the drawings in detail, a protective case for six different sized memory cards is shown in FIG. 1, and is generally designated by the reference numeral 10. The case 10 includes a base 12 and a top 14, secured to the base 12 by a hinge 16. The case may be made of a single molded plastic component, or any other material known in the art capable of securing memory cards. The base 12 includes a first small sized memory card securing means 18 for securing a first small sized memory card 20 (shown in FIG. 5) within or adjacent to the base 12 against unassisted removal from the case 10. By the phrase "against unassisted removal from the base", it is meant that the memory cards referred to herein may not fall or tumble out of the case by the force of gravity alone, and instead require a user to apply a common removal force known in the art to remove the cards from the case, thereby protecting the cards against accidental damage from falling out of the case 10, such as upon opening of the case 10.

The first small sized card securing means 18 includes two opposed pyramid posts 22, 24 secured to the base 12 and disposed to face each other from opposed length sides of a first rectangular alignment 26. The first rectangular alignment 26 is shown in FIG. 1 as two length lines and two width lines, as a common representation of a rectangle. The first rectangular alignment 26 may also include edges in the base in the form of an indentation for ease of securing and alignment of the first small sized memory card 20. For purposes herein however, the phrase "rectangular alignment" is meant to characterize a definition of an approximate rectangle as defined by components described herein to be along both length and width lines of the rectangular alignment, wherein the "rectangular alignment" approximates length and width dimensions of a particular, described memory card. It is stressed as well that the word "length" and the word "width" may be associated herein and in general usage with the longest and shortest sides respectively of a rectangle. However, for purposes herein, no such limitation in intended, and the word "length" may mean either the longest or shortest side of the described and claimed rectangular alignment, or an equal side in the case of a square rectangle. Likewise, the word "width" may also mean either the longest or shortest, or equal side.

Figure 5:
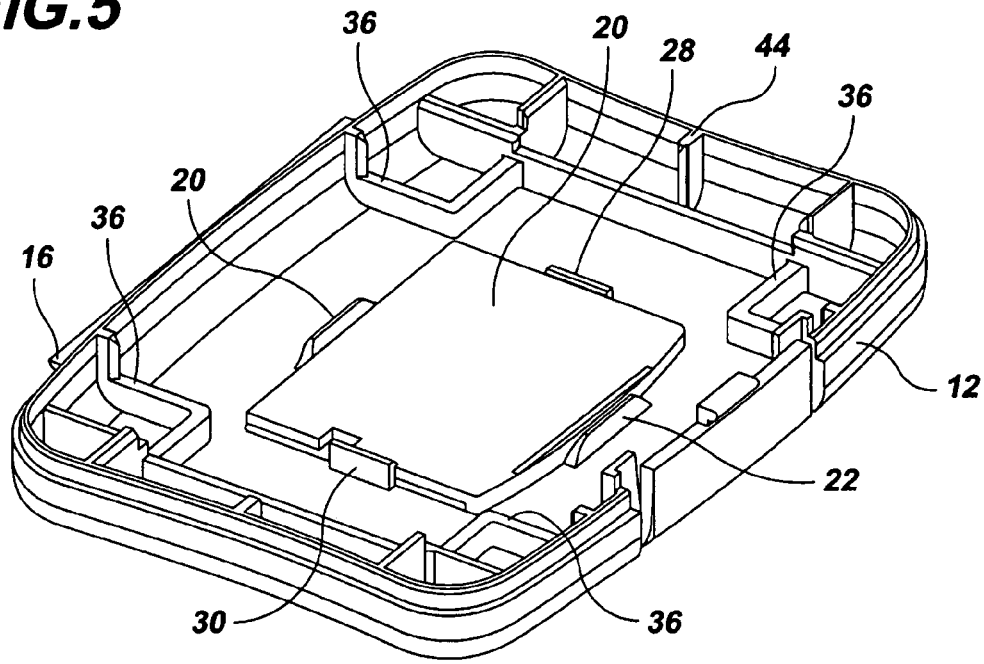
FIG. 5 is a perspective view of the base of the protective case shown in FIG. 2 with a first small sized memory card secured within the base.

The first small sized card securing means 18 also includes two inverse "L" shaped posts 28, 30 secured to the base 12 and disposed to face each other from opposed width sides of the first rectangular alignment 18 so that the two pyramid posts 22, 24 and two inverse "L" shaped posts 28, 30 are secured to four sides of the first rectangular alignment 26. As best seen in FIG. 5, the two pyramid posts 22, 24 are dimensioned to engage and guide two opposed length edges of the first small sized memory card 20. The two inverse "L" shaped posts 28, 30 are made of a flexible material (such as the same plastic making up the entire case 10), and are adequately thin, or dimensioned to flex aside, in a direction away from the first rectangular alignment 26 to permit the first small sized memory card 20 to pass under the inverse "L" shaped posts 28, 30 and to flex back so that the posts 28, 30 overlie the first small sized memory card 20, as shown in FIG. 5, in order to secure the first small sized memory card 20 within and adjacent to the base 12 against unassisted removal of the card 20 from the case 10. To remove the first small sized memory card 20 from the base 12, a user simply flexes one of the inverse "L" shaped posts 28, 30 away from the first rectangular alignment and lifts the memory card 20 out of the base 12.

Figure 2:
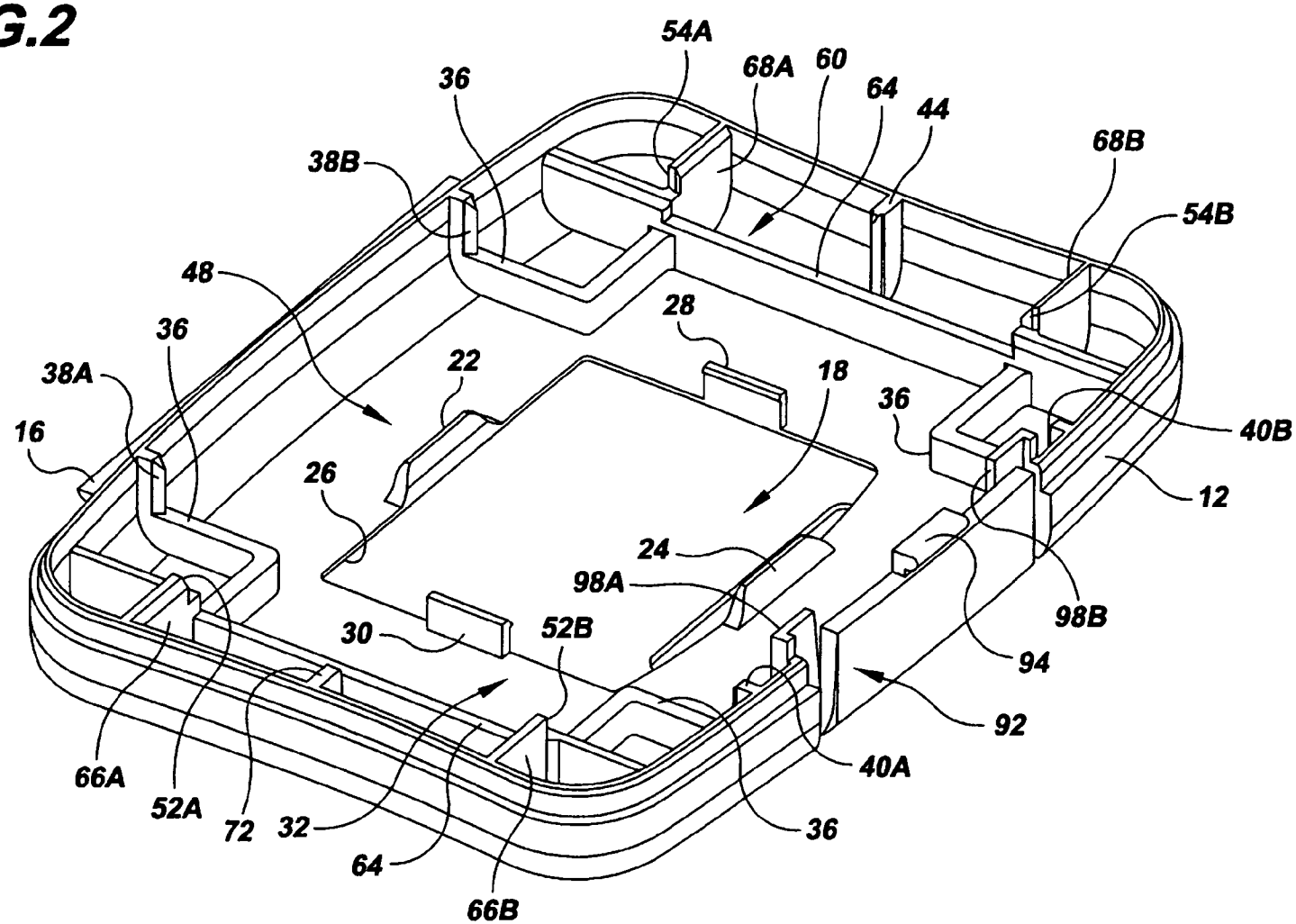
FIG. 2 is a perspective view of the base of the protective case shown in FIG. 1.
Figure 6:
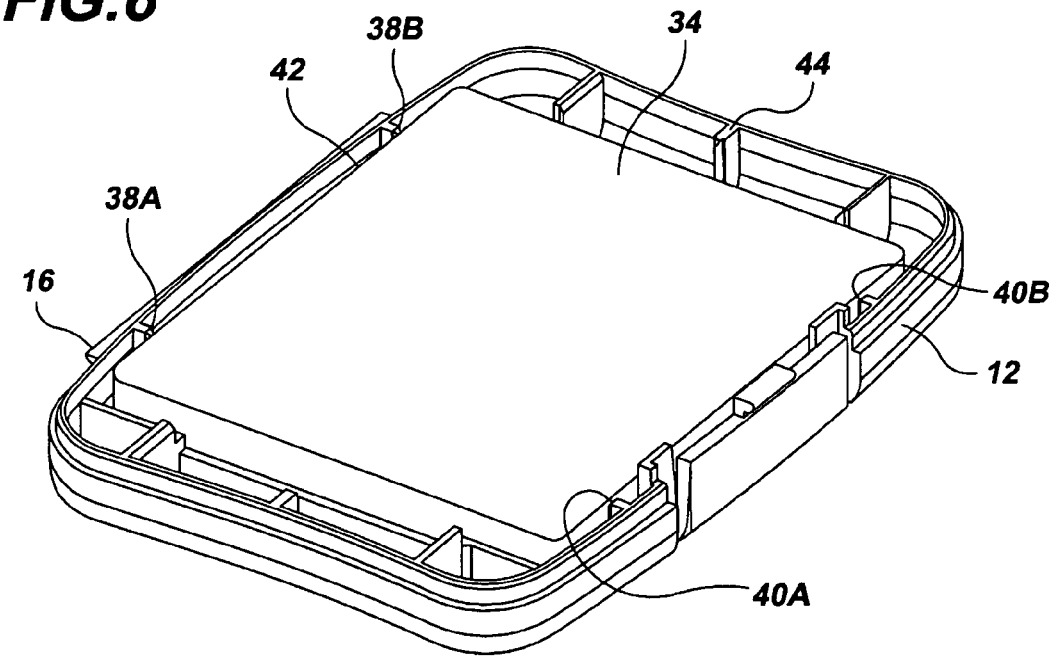
FIG. 6 is a perspective view of the base of the protective case shown in FIG. 2 with a first large sized memory card secured within the base.

As best shown in FIG. 2, the base 12 also includes a first large sized securing means 32 for securing a first large sized memory card 34 (shown in FIG. 6) within the base against unassisted removal from the case 10. The first large sized memory card securing means 32 includes a first support shelf 36 that may consist of a plurality of shelf components 36 (as shown in FIG. 2) that are secured at four corners of the base 12 and are dimensioned to support the first large sized memory card 34 above the first small sized memory card securing means 18 in a direction away from the base 12. The first large sized memory card securing means 32 also includes a first pair of crush ribs 38A, 38B, and an opposed second pair of crush ribs 40A, 40B (shown best in FIGS. 2 and 6) secured to the base 12 and extending above the first support shelf 36 in a direction away from the base 12, and disposed so that the first pair of crush ribs 38A, 38B faces the second pair of crush ribs 40A, 40B from opposed length sides of a second rectangular alignment 42 (shown in FIG. 6 as about the same as length and width dimensions of the first large sized memory card 24). The opposed pairs of crush ribs 38A, 38B, 40A, 40B are also positioned so that the crush ribs deform and apply an elastic friction force to the first large sized memory card 34 whenever the first large sized memory card 34 is positioned between the opposed pairs of crush ribs 38A, 38B, 40A, 40B, as show in FIG. 6.

Figure 3:
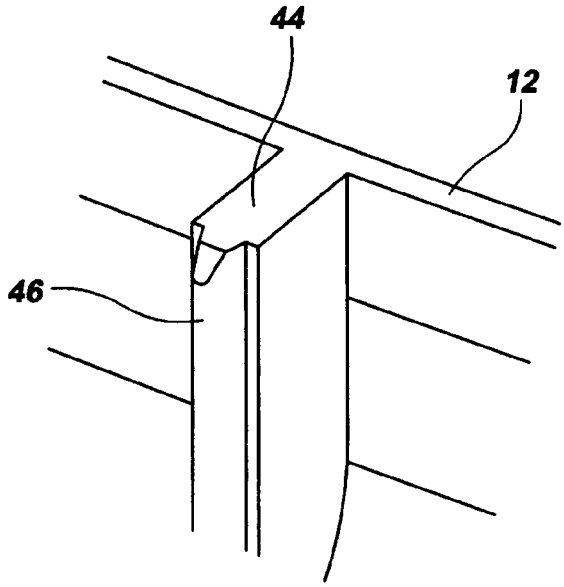
FIG. 3 is an expanded, fragmentary view of a crush rib of the FIG. 2 base.

An additional crush rib 44 is shown secured to the base 12, and in an expanded, fragmentary view in FIG. 3 to explain the functioning of the crush ribs 38A, 38B, 40A, 40B, 44. As seen in FIG. 3, the crush rib 44 is simply a projection from the base 12 having a wedge, or "V" shaped contact edge 46 that becomes so narrow that the contact edge 46 may be easily deformed or crushed upon contact with a memory card such as the first large sized memory card 34. The first and second pairs of crush ribs 38A, 38B, 40A, 40B are positioned within the base 12 in order to apply an elastic friction force to the first large sized memory card 34 whenever the first large sized memory card 34 is positioned between the opposed pairs of crush ribs 38A, 38B, 40A, 40B. The friction force of the crush ribs 38A, 38B, 40A, 40B secures the first large sized memory card 34 against unassisted removal from the case 10.

Figure 7:
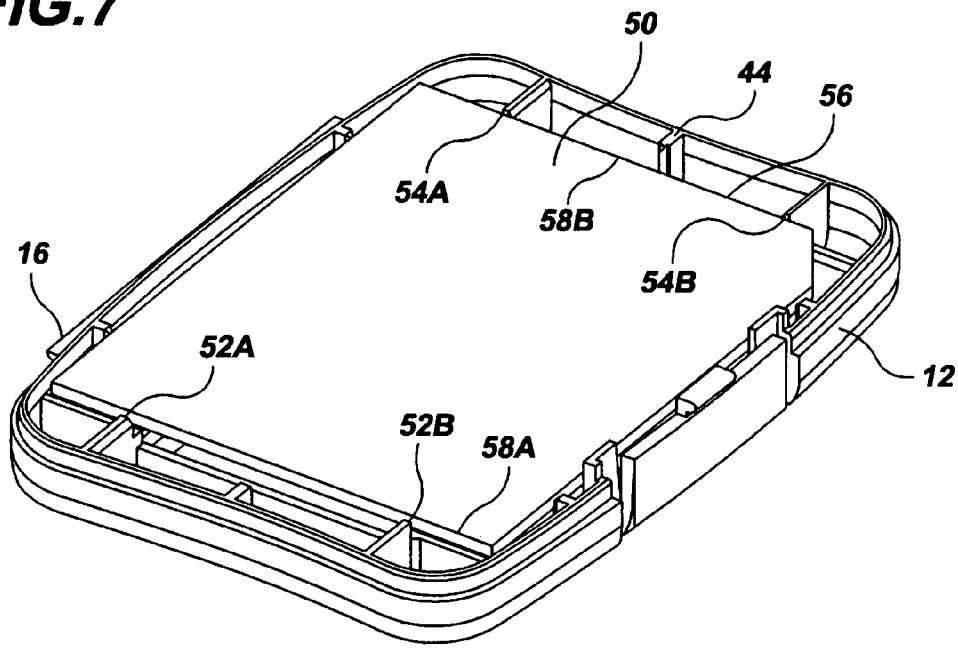
FIG. 7 is a perspective view of the base of the protective case shown in FIG. 2 with a second large sized memory card secured within the base.

As seen in FIG. 2, the base 12 also includes a second large sized memory card securing means 48 for securing a second large sized memory card 50 (shown in FIG. 7) within the base 12 against unassisted removal from the base 12. The second large sized memory card securing means 48 includes the first support shelf 36 described above, the first pair of crush ribs 38A, 38B and the opposed second pair of crush ribs 40A, 40B, a first pair of edge posts 52A, 52B, and an opposed second pair of edge posts 54A, 54B, secured to the base 12. The first pair of crush ribs 38A, 38B, and opposed second pair of crush ribs 40A, 40B are disposed in association with the first and opposed second pair of edge posts 52A, 52B, 54A, 54B so that the pairs of crush ribs and edge posts define a third rectangular alignment 56 (shown in FIG. 7 and characterized as about the same as length and width dimensions of the second large sized memory card 50). The opposed pairs of edge posts 52A, 52B, 54A, 54B are positioned within the base to contact at least one width edge 58A, 58B of the second large sized memory card 50 whenever the second large sized memory card 50 is secured within the base 12 by the friction of the deformed crush ribs 38A, 38B, 40A, 40B, as described above. For purposes of the second large sized memory card 50, the width edges 58A, 58B are defined to mean those edges not in contact with the opposed pairs of crush ribs 38A, 38B, 40A, 40B. As shown in the contrast of the sizes of the first large sized memory card 34 in FIG. 6 and the second large sized memory card 50 in FIG. 7, the two large sized cards 34 50 have about the same width dimensions extending between the opposed pair of crush ribs 38A, 38B, 40A, 40B, but the cards 34, 50 have different length dimensions, wherein the second large sized card 50 is longer than the first large sized memory card 34.

Figure 8:
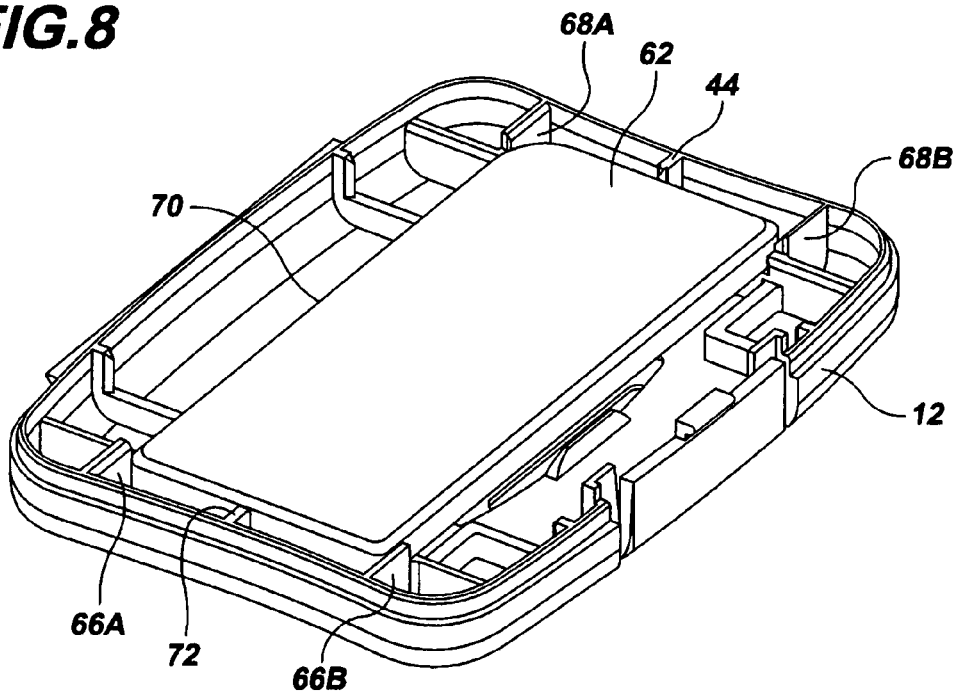
FIG. 8 is a perspective view of the base of the protective case shown in FIG. 2 with a third large sized memory card secured within the base.

The base 12 also includes a third large sized memory card securing means 60 for securing a third large sized memory card 62 (shown in FIG. 8) within the base 12 against unassisted removal from the case 10. The third large sized memory card securing means 60 includes a second support shelf 64 secured to the base 12 and dimensioned to support the third large sized memory card above the first small sized securing means 18 in a direction away from the base 12 toward the top 14. The third large sized memory card securing means 60 also includes a first pair of alignment ribs 66A, 66B and an opposed second pair of alignment ribs 68A, 68B secured to and extending above the second support shelf 64 in a direction away from the base 12 toward the top 14. The first pair of alignment ribs 66A, 66B and second pair of alignment ribs 68A, 68B are disposed to face each other from opposed length sides of a fourth rectangular alignment 70 (shown in FIG. 8 as about the same as length and width dimensions of the third large sized memory card 62). The third large sized memory card securing means 60 also includes at least one crush rib 44 and at least one blocking rib 72 secured to the base 12 and disposed so that the crush rib 44 and blocking rib 72 face each other from opposed width sides of the fourth rectangular alignment 70. The blocking rib 72 may also be in the form of a crush rib in certain embodiments. The crush rib 44 is positioned so that the crush rib 44 deforms and applies an elastic friction force to the third sized memory card 62 whenever the third sized memory card 62 is positioned between the opposed pairs of alignment ribs 66A, 66B, 68A, 68B, blocking rib 72 and crush rib 44, to thereby secure the third large sized memory card 60 against unassisted removal from the case 10.

Figure 4:
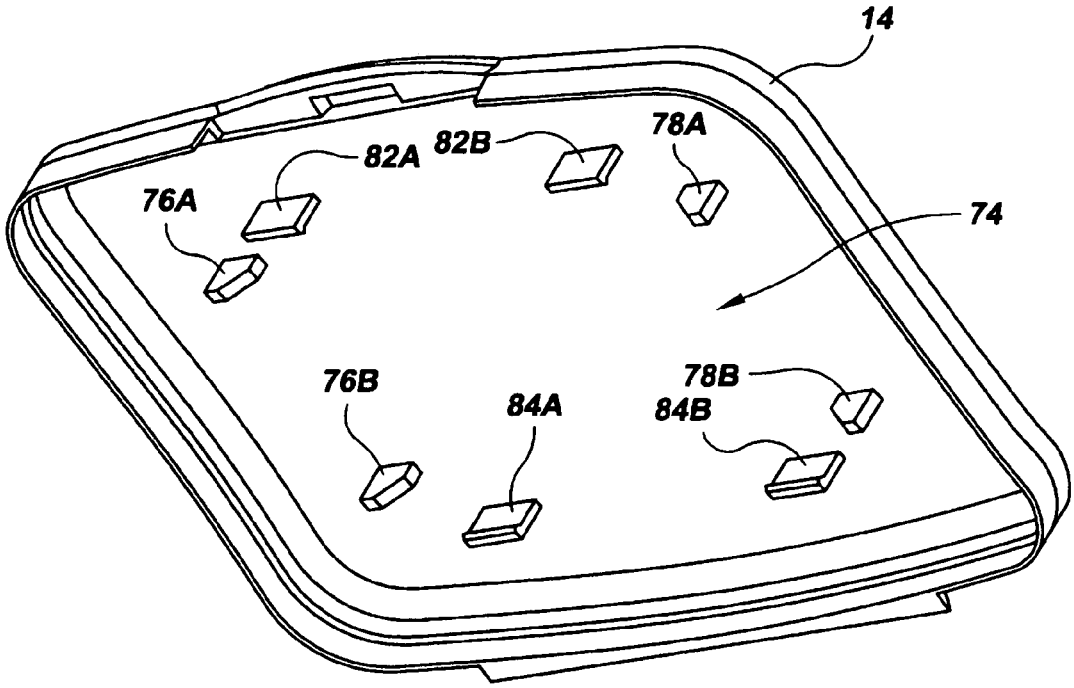
FIG. 4 is a perspective view of the top of the protective case shown in FIG. 1.
Figure 9:
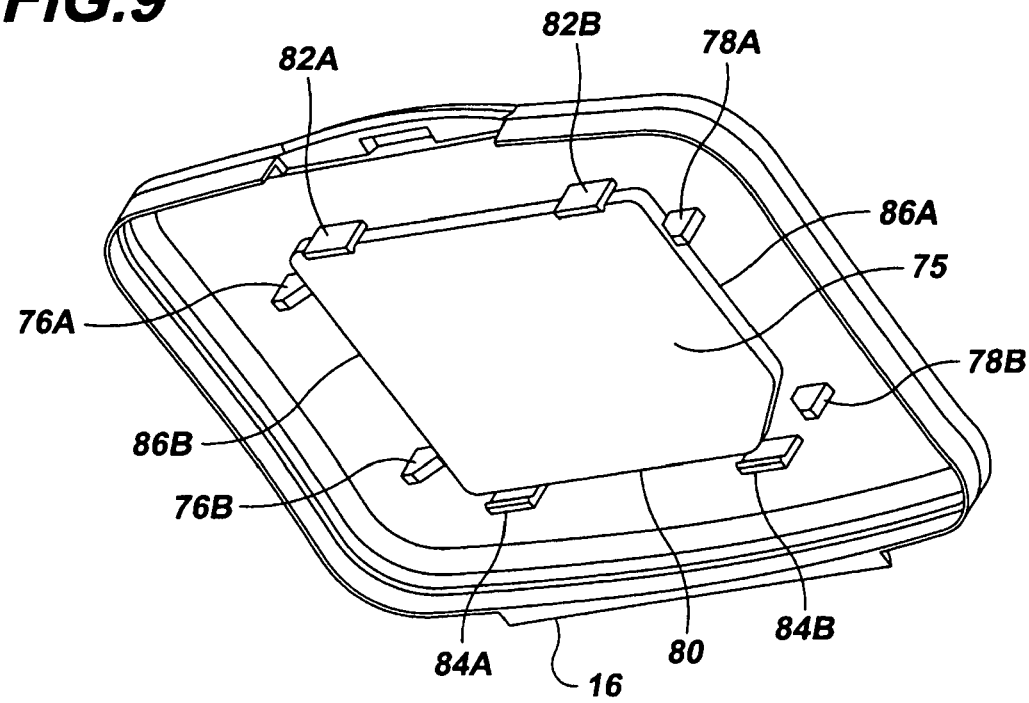
FIG. 9 is a perspective view of the top of the protective case shown in FIG. 4 with a second small sized memory card secured within the top.
Figure 10:
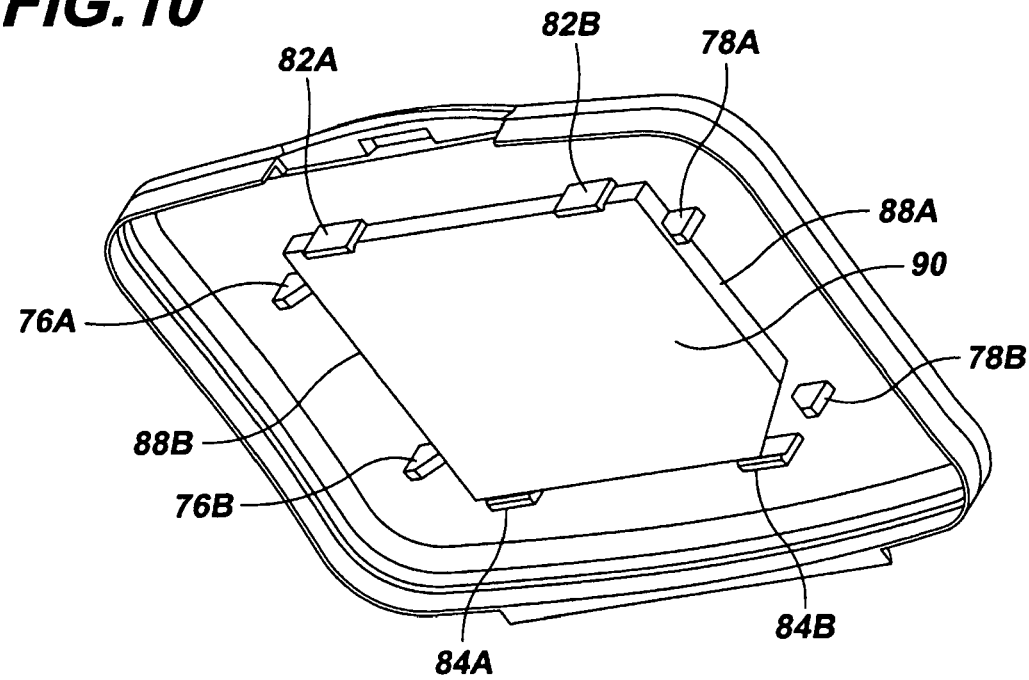
FIG. 10 is a perspective view of the top of the protective case shown in FIG. 4 with a third small sized memory card secured within the top.

As shown best in FIGS. 4 and 9, the top 14 includes a second small sized memory card securing means 74 for securing a second small sized memory card 75 (shown in FIG. 9) and a third small sized memory card 90 (shown in FIG. 10) against unassisted removal from the case 10. The second small sized memory card securing means 74 includes a first pair of pyramid posts 76A, 76B and an opposed second pair of pyramid post 78A, 78B secured to the top 14 and disposed to face each other from opposed width sides of a fifth rectangular alignment 80 (shown in FIG. 9 as about the same as length and width dimensions of the second small sized memory card 75). The second small sized memory card securing means 74 also includes a first pair of inverse "L" shaped posts 82A, 82B, and an opposed second pair of inverse "L" shaped posts 84A, 84B secured to the top and disposed to face each other from opposed length sides of the fifth rectangular alignment 80. The opposed pairs of pyramid posts 76A, 76B, 78A, 78B, are dimensioned and positioned to engage and guide two opposed width edges 86A, 86B of the second small sized memory card 75, or two opposed width edges 88A, 88B of the third small sized card 90 as either one of the cards 75 or 90 is positioned within the second small sized memory card securing means 74. The opposed pairs of inverse "L" shaped posts 82A, 82B, 84A, 84B are flexible, and dimensioned to flex away from the fifth rectangular alignment 80 to permit the second small sized card 75 to pass under the posts and to flex back toward the fifth rectangular alignment 80 so that the posts overlie but do not contact the second small sized memory card 75, as shown for example in FIG. 9, at reference numerals 84A, 84B. This permits unassisted movement of the card 75 toward and away from the top 14, but not out of the second small sized memory card securing means 74.

The opposed pairs of inverse "L" shaped posts 82A, 82B, 84A, 84B are also dimensioned to flex away from the fifth rectangular alignment 80 to permit the third small sized memory card 90 to pass under the posts and to flex back toward the fifth rectangular alignment 80 so that the posts overlie and contact the third small sized memory card 90 so that the card 90 is secured against unassisted movement toward and away from the top 14 and out of the second small sized memory card securing means 74 and case 10. As is apparent from FIGS. 9 and 10, the second small sized memory card 75 and third small sized memory card 90 share about the same length and width dimensions, but the second small sized memory card 75 has a smaller thickness dimension than the third small sized memory card 90. (For purposes herein, the word "about" is to mean plus or minus ten percent.)

As shown best in FIGS. 1 and 2, the case 10 also includes latch means 92 secured to the case 12 for selectively opening and closing the case 12 by securing the base 12 to the top 14 as is known in the art in order to protect contents stored within the case 12. The latch means 92 may be any latch mechanism known in the art, especially in plastic technology, and may include a plastic tensile biased hinge shoulder 94 on the base 12 dimensioned to be received and secured in a latch slot 96 defined within the top 14 to close the case 10, and to be compressed against the tensile biasing of the plastic hinge shoulder 94 toward the first small sized memory card securing means 18 to be released out of the latch slot 96 to open the case 10, in a manner known in the art. The plastic tensile biased hinge shoulder 94 may also include a pair of tensile pillars 98A, 98B secured adjacent opposed edges of and integral with the shoulder 94 that increase a total strength and elastic memory of the shoulder 94 so that the shoulder exerts a greater biasing force outward, away from the first securing means 18 to keep the case 10 closed, and to prolong the elastic memory of the hinge shoulder 94 for an extended useful life of the case 10.

As is apparent, the described first 18, second 32, third 48, fourth 60, and fifth 74 memory card securing means are cooperatively dimensioned so that the case 10 may simultaneously secure up to three memory cards at once. For example, the case 10 may secure the first small sized memory card 20 within the base 12, the first 34, second 50 or third 62 large sized memory card within the base 12 above the first small sized card 20, and either the second small sized memory card 75 or the third small sized memory card 90 within the top 90 of the case 10.

The protective case 10 for six different sized memory cards also achieves remarkable efficiency in its small size. This is accomplished because the five rectangular alignments 26, 42, 56, 70 and 80 defined by the five securing means 18, 32, 48, 60, 74 overlie each other whenever the case 10 is closed so that the top 14 is secured to the base 12 by the latch 92. By the phrase "the five rectangular alignments 26, 42, 56, 70 and 80 defined by the five securing means 18, 32, 48, 60, 74 overlie each other", it is meant that a vertical axis passing through and perpendicular to a smallest rectangular alignment, such as the first rectangular alignment 26, also passes through all the other rectangular alignments, such as the second, third, fourth and fifth rectangular alignments 42, 56, 70 and 80. By the extraordinarily efficient design in structuring the five securing means 18, 32, 48, 60, 74 to overlie each other, the protective case 10 for securing and protecting six different sized memory cards 20, 34, 50, 62, 75, 90 is readily distinguished from containers that define "side-by-side" or "egg carton" types of securing apparatus.

In an exemplary embodiment of the protective case 10, the first, second and third small sized memory cards 20, 75, 90, and the first, second and third large sized memory cards 34, 50, 62 may be dimensioned to correspond to the peripheral dimensions of the respective three small and three large sized memory cards associated with well-known brand names. For example, the first small sized memory card securing means 18 within the base 12 may be dimensioned to secure a memory card available under the brand name "XD PICTURE CARD"; the second small sized memory card securing means 74 within the top 14 may be dimensioned to secure second and third sized memory cards 75, 90 available respectively under the well known brand names "MMC" and "SD". The first large sized memory card securing means 32 may be dimensioned to secure a memory card available under the brand name "COMPACTFLASH" as the first large sized memory card 34; the second large sized memory card securing means 48 may be dimensioned to secure a memory card available under the brand name "SMART MEDIA" as the second large sized memory card 50; and, the third large sized memory card securing means 60 may dimensioned to secure a memory card available under the well known brand name "SONY MEMORY STICK" as the third large sized memory card 62.

The hinge 16 may be any hinge known in the art for securing a base to a top to form a case, such as a thin section of plastic 16 integral with the base 12 and top 14, or separable components known in the art.

While the present invention has been disclosed with respect to the described and illustrated embodiments, it is to be understood that the invention is not to be limited to those embodiments. Accordingly, reference should be made primarily to the following claims rather than the foregoing description to determine the scope of the invention.

What is claimed is:

1. A protective case (10) for securing and protecting six different sized memory cards (20, 34, 50, 62, 75, 90) having exterior dimensions of length, width and thickness distinct from each other, the case (10) comprising:

a. a base (12) including a first small sized memory card securing means (18) for securing a first small sized memory card (20) within the base (12) against unassisted removal from the case (10), a first large sized memory card securing means (32) for securing a first large sized memory card (34) within the base (12) against unassisted removal from the case (10), a second large sized memory card securing means (48) for securing a second large sized memory card (50) within the base against unassisted removal from the case, a third large sized memory card securing means (60) for securing a third large sized memory card (62) within the base (12) against unassisted removal from the case (10);

b. a top (14) hinged to the base (12) by a plastic hinge (16) integral with the base (12) and top (14) so that the base (12), hinge (16) and top (14) form a single molded plastic case (10), the top (14) including a second small sized memory card securing means (74) for securing a second small sized memory card (75) and a third small sized memory card (90) within the top (14) against unassisted removal from the case (10);

c. latch means (92) secured to the case (10) for securing the base (12) to the top (14) for selectively opening and closing the case (10) by securing the top (14) to the base (12) to protect one or more memory cards secured within the case (10);

d. wherein rectangular alignments (26, 42, 56, 70, 80) defined by the five memory card securing means (18, 32, 48, 60, 74) overlie each other whenever the latch means (92) secures the base (12) to the top (14); and e. wherein a maximum of three memory cards may be simultaneously secured against unassisted removal from the case (10).

2. The protective case (10) of claim 1, wherein the first small sized memory card securing means (18) comprises two opposed pyramid posts (22, 24) secured to the base (12) and disposed to face each other from opposed length sides of a first rectangular alignment (26) and two inverse "L" shaped posts (28, 30) secured to the base (12) and disposed to face each other from opposed width sides of the first rectangular alignment (26) so that the two pyramid posts (22, 24) and two inverse "L" shaped posts (28, 30) are secured to four sides of the first rectangular alignment (26), the pyramid posts (22, 24) being dimensioned to engage and guide two opposed length edges of the first small sized memory card (20), and the two inverse "L" shaped posts (28, 30) being flexible and dimensioned to flex away from the first rectangular alignment (26) to permit the first small sized memory card (20) to pass under the posts (28, 30) and to flex back so that the posts overlie and secure the first sized memory (20) card within the first small sized memory card securing means (18).

3. The protective case (10) of claim 1, wherein the first large sized memory card securing means (32) comprises a first support shelf (36) secured to the base (12) and dimensioned to support the first large sized memory card (34) above the first small sized securing means (18) in a direction away from the base (12) toward the top (14), a first pair of crush ribs (38A, 38B) and an opposed second pair of crush ribs (40A, 40B) secured to the base (12) and extending above the first support shelf (36) and disposed so that the first and second pairs of crush ribs (38A, 38B, 40A, 40B) face each other from opposed length sides of a second rectangular alignment (42) and the opposed pair of crush ribs (38A, 38B, 40A, 40B) are positioned so that the crush ribs (38A, 38B, 40A, 40B) deform and apply an elastic friction force to the first large sized memory card (34) whenever the first large sized memory card (34) is positioned between the opposed pairs of crush ribs (38A, 38B, 40A, 40B).

4. The protective case (10) of claim 1, wherein the second large sized memory card securing means (48) comprises a first support shelf (36), the first and second opposed pairs of crush ribs (38A, 38B, 40A, 40B), and a first pair of edge posts (52A, 52B) and an opposed second pair of edge posts (54A, 54B) secured to the base (12) and disposed so that the first and opposed second pair of edge posts (52A, 52B, 54A, 54B) face each other from opposed width sides a third rectangular alignment (56) and the opposed pairs of edge posts (52A, 52B, 54A, 54B) are positioned to contact at least one width edge of the second large sized memory card (50).

5. The protective case (10) of claim 1, wherein the third large sized memory card securing means (60) comprises a second support shelf (64) secured to the base (10) and dimensioned to support the third large sized memory card (62) above the first small sized securing means (18) in a direction away from the base (12) toward the top (14), a first pair of alignment ribs (66A, 66B) and a second pair of alignment ribs (68A, 68B) secured and extending above a first support shelf (36) and disposed so that the first and second pairs of alignment ribs (66A, 66B, 68A, 68B) face each other from opposed length sides of a fourth rectangular alignment (70), at least one crush rib (44) and at least one blocking rib (72) secured to the base (12) and disposed so that the crush rib (44) and blocking rib (70) face each other from opposed width sides of the fourth rectangular alignment (70), the crush rib (44) positioned so that the crush rib (44) deforms and applies an elastic friction force to the third sized memory card (62) whenever the third sized memory card (62) is positioned between the opposed pairs of alignment ribs (66A, 66B, 68A, 68B, blocking rib (72) and crush rib (44).

6. The protective case (10) of claim 1, wherein the second small sized memory card securing means (74) comprises a first pair of pyramid posts (76A, 76B) secured to the top (14), and an opposed second pair of pyramid posts (78A, 78B) secured to the top (14) and disposed to face each other from opposed width sides of a fifth rectangular alignment (80), a first pair of inverse "L" shaped posts (82A, 82B) and opposed second pair of inverse "L" shaped posts (84A, 84B) secured to the top (14) and disposed to face each other from opposed length sides of the fifth rectangular alignment (80), the opposed pairs of pyramid posts (76A, 76B, 78A, 78B) being dimensioned to engage and guide two opposed width edges of the second small sized memory card (75), and the opposed pairs of inverse "L" shaped posts (82A, 82B, 84A, 84B) being flexible and dimensioned to flex away from the fifth rectangular alignment (80) to permit the second small sized memory card (75) to pass under the posts (82A, 82B, 84A, 84B) and to flex back so that the posts overlie but do not contact the second small sized memory card (75) permitting unassisted movement of the second sized memory (75) card toward and away from the top (14) but not out of the second small sized memory card securing means (74), the first and second opposed pairs of inverse "L" shaped posts (82A, 82B, 84A, 84B) being also dimensioned to flex away from the fifth rectangular alignment (80) to permit the third small sized memory card (90) to pass under the posts (82A, 82B, 84A, 84B) and to flex back so that the posts overlie and contact the third small sized memory card (90) so that the third small sized memory card (90) is secured against unassisted movement toward and away from the top (14) and out of the second small sized card securing means (74).

7. The protective case of claim 1, wherein the first small sized memory card securing means (18), the second small sized memory card securing means (74) and the first, second and third large sized memory card securing means (32, 48, 60) are cooperatively dimensioned so that a combination of the first small sized memory card (20) and either the second small sized memory card (75) or the third small sized memory card (90), and the first, second or third large sized memory card (34, 50, 60) may be simultaneously secured against unassisted removal from the case (10).

8. The protective case of claim 1, wherein the latch means (92) includes an elastic biased hinge shoulder (92) secured to the case (10) having a pair of tensile pillars (98A, 98B) secured adjacent opposed edges of and integral with the shoulder (94), the tensile pillars (98A, 98B) being dimensioned to increase a total strength and elastic memory of the shoulder (94) so that the shoulder (94) may exert a biasing force away from the first securing means (18) to assist in keeping the case (10) closed, and to prolong an elastic memory of the hinge shoulder (94).

9. A protective case (10) for securing and protecting six different sized memory cards (20, 34, 50, 62, 75, 90) having exterior dimensions of length, width and thickness distinct from each other, the case (10) comprising:

a. a base (12) including a first small sized memory card securing means (18) for securing a first small sized memory card (20) within the base (12) against unassisted removal from the case (10), a first large sized memory card securing means (32) for securing a first large sized memory card (34) within the base (12) against unassisted removal from the case (10), a second large sized memory card securing means (48) for securing a second large sized memory card (50) within the base against unassisted removal from the case, a third large sized memory card securing means (60) for securing a third large sized memory card (62) within the base (12) against unassisted removal from the case (10);

b. a top (14) hinged to the base (12) by a plastic hinge (16) integral with the base (12) and top (14) so that the base (12), hinge (16) and top (14) form a single molded plastic case (10), the top (14) including a second small sized memory card securing means (74) for securing a second small sized memory card (75) and a third small sized memory card (90) within the top (14) against unassisted removal from the case (10);

c. latch means (92) secured to the case (10) for securing the base (12) to the top (14) for selectively opening and closing the case (10) by securing the top (14) to the base (12) to protect one or more memory cards secured within the case (10);

d. wherein rectangular alignments (26, 42, 56, 70, 80) defined by the five memory card securing means (18, 32, 48, 60, 74) overlie each other whenever the latch means (92) secures the base (12) to the top (14); and, e. wherein the first small sized memory card securing means (18), the second small sized memory card securing means (74) and the first, second and third large sized memory card securing means (32, 48, 60) are cooperatively dimensioned so that a maximum of the first small sized memory card (20) and either the second small sized memory card (75) or the third small sized memory card (90), and the first, second or third large sized memory card (34, 50, 60) may be simultaneously secured against unassisted removal from the case (10).

10. The protective case (10) of claim 9, wherein the first small sized memory card securing means (18) comprises two opposed pyramid posts (22, 24) secured to the base (12) and disposed to face each other from opposed length sides of a first rectangular alignment (26) and two inverse "L" shaped posts (28, 30) secured to the base (12) and disposed to face each other from opposed width sides of the first rectangular alignment (26) so that the two pyramid posts (22, 24) and two inverse "L" shaped posts (28, 30) are secured to four sides of the first rectangular alignment (26), the pyramid posts (22, 24) being dimensioned to engage and guide two opposed length edges of the first small sized memory card (20), and the two inverse "L" shaped posts (28, 30) being flexible and dimensioned to flex away from the first rectangular alignment (26) to permit the first small sized memory card (20) to pass under the posts (28, 30) and to flex back so that the posts overlie and secure the first sized memory (20) card within the first small sized memory card securing means (18).

11. The protective case (10) of claim 10, wherein the first large sized memory card securing means (32) comprises a first support shelf (36) secured to the base (12) and dimensioned to support the first large sized memory card (34) above the first small sized securing means (18) in a direction away from the base (12) toward the top (14), a first pair of crush ribs (38A, 38B) and an opposed second pair of crush ribs (40A, 40B) secured to the base (12) and extending above the first support shelf (36) and disposed so that the first and second pairs of crush ribs (38A, 38B, 40A, 40B) face each other from opposed length sides of a second rectangular alignment (42) and the opposed pair of crush ribs (38A, 38B, 40A, 40B) are positioned so, that the crush ribs (38A, 38B, 40A, 40B) deform and apply an elastic friction force to the first large sized memory card (34) whenever the first large sized memory card (34) is positioned between the opposed pairs of crush ribs (38A, 38B, 40A, 40B).

12. The protective case (10) of claim 11, wherein the second large sized memory card securing means (48) comprises the first support shelf (36), the first and second opposed pairs of crush ribs (38A, 38B, 40A, 40B), and a first pair of edge posts (52A, 52B) and an opposed second pair of edge posts (54A, 54B) secured to the base (12) and disposed so that the first and opposed second pair of edge posts (52A, 52B, 54A, 54B) face each other from opposed width sides a third rectangular alignment (56) and the opposed pairs of edge posts (52A, 52B, 54A, 54B) are positioned to contact at least one width edge of the second large sized memory card (50).

13. The protective case (10) of claim 12, wherein the third large sized memory card securing means (60) comprises a second support shelf (64) secured to the base (10) and dimensioned to support the third large sized memory card (62) above the first small sized securing means (18) in a direction away from the base (12) toward the top (14), a first pair of alignment ribs (66A, 66B) and a second pair of alignment ribs (68A, 68B) secured and extending above the first support shelf (36) and disposed so that the first and second pairs of alignment ribs (66A, 66B, 68A, 68B) face each other from opposed length sides of a fourth rectangular alignment (70), at least one crush rib (44) and at least one blocking rib (72) secured to the base (12) and disposed so that the crush rib (44) and blocking rib (70) face each other from opposed width sides of the fourth rectangular alignment (70), the crush rib (44) positioned so that the crush rib (44) deforms and applies an elastic friction force to the third sized memory card (62) whenever the third sized memory card (62) is positioned between the opposed pairs of alignment ribs (66A, 66B, 68A, 68B, blocking rib (72) and crush rib (44).

14. The protective case (10) of claim 13, wherein the second small sized memory card securing means (74) comprises a first pair of pyramid posts (76A, 76B) secured to the top (14), and an opposed second pair of pyramid posts (78A, 78B) secured to the top (14) and disposed to face each other from opposed width sides of a fifth rectangular alignment (80), a first pair of inverse "L" shaped posts (82A, 82B) and opposed second pair of inverse "L" shaped posts (84A, 84B) secured to the top (14) and disposed to face each other from opposed length sides of the fifth rectangular alignment (80), the opposed pairs of pyramid posts (76A, 76B, 78A, 78B) being dimensioned to engage and guide two opposed width edges of the second small sized memory card (75), and the opposed pairs of inverse "L" shaped posts (82A, 82B, 84A, 84B) being flexible and dimensioned to flex away from the fifth rectangular alignment (80) to permit the second small sized memory card (75) to pass under the posts (82A, 82B, 84A, 84B) and to flex back so that the posts overlie but do not contact the second small sized memory card (75) permitting unassisted movement of the second sized memory (75) card toward and away from the top (14) but not out of the second small sized memory card securing means (74), the first and second opposed pairs of inverse "L" shaped posts (82A, 82B, 84A, 84B) being also dimensioned to flex away from the fifth rectangular alignment (80) to permit the third small sized memory card (90) to pass under the posts (82A, 82B, 84A, 84B) and to flex back so that the posts overlie and contact the third small sized memory card (90) so that the third small sized memory card (90) is secured against unassisted movement toward and away from the top (14) and out of the second small sized card securing means (74).

* * * * *